US007695088B2

(12) United States Patent
Yamane et al.

(10) Patent No.: US 7,695,088 B2
(45) Date of Patent: Apr. 13, 2010

(54) INK JET PRINTING APPARATUS AND INK JET PRINTING METHOD

(75) Inventors: Toru Yamane, Yokohama (JP); Mineo Kaneko, Tokyo (JP); Ken Tsuchii, Sagamihara (JP); Masaki Oikawa, Inagi (JP); Keiji Tomizawa, Yokohama (JP); Mitsuhiro Matsumoto, Yokohama (JP); Shuichi Ide, Tokyo (JP); Kansui Takino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 11/953,996

(22) Filed: Dec. 11, 2007

(65) Prior Publication Data

US 2008/0150991 A1 Jun. 26, 2008

(30) Foreign Application Priority Data

Dec. 12, 2006 (JP) ..... 2006-334730

(51) Int. Cl.
*B41J 29/38* (2006.01)

(52) U.S. Cl. ..... 347/14; 347/15

(58) Field of Classification Search ..... 347/14, 347/15, 19, 43

See application file for complete search history.

(56) References Cited

U.S. PATENT DOCUMENTS

| | | | | |
|---|---|---|---|---|
| 5,427,461 | A | 6/1995 | Hirai et al. | |
| 5,458,254 | A | 10/1995 | Miyagawa et al. | |
| 5,790,150 | A * | 8/1998 | Lidke et al. | 347/41 |
| 6,270,178 | B1 * | 8/2001 | Wada et al. | 347/7 |
| 6,390,585 | B1 * | 5/2002 | Schiaffino et al. | 347/17 |
| 6,648,439 | B2 | 11/2003 | Oikawa | |
| 6,874,864 | B1 | 4/2005 | Maeda et al. | |

FOREIGN PATENT DOCUMENTS

| | | |
|---|---|---|
| JP | 54-51837 | 4/1979 |
| JP | 5-330066 | 12/1993 |
| JP | 2002-96455 | 4/2002 |

* cited by examiner

*Primary Examiner*—Thinh H Nguyen
(74) *Attorney, Agent, or Firm*—Fitzpatrick, Cella, Harper & Scinto

(57) ABSTRACT

A scanning speed for a carriage and a number of multi-pass are set in accordance with print density information of dots obtained from image data. This makes it possible to preferably output an image free from the occurrence of an end deviation without reducing throughput to a required extent or more.

8 Claims, 14 Drawing Sheets

| | REFERENCE CONDITION | A | B | B′ | C | C′ | D |
|---|---|---|---|---|---|---|---|
| | 25″ / s TWO PASSES | duty × 1/2 (NUMBER OF PASSES × 2) | CR SPEED × 1/2 | CR SPEED × 1/2 (NUMBER OF PASSES × 1/2) | CR SPEED × 2 (NUMBER OF PASSES × 2) | CR SPEED × 1.5 (NUMBER OF PASSES × 1.5) | CR SPEED × 2 (NUMBER OF PASSES IS UNCHANGED) |
| NUMBER OF PASSES | 2 | 4 | 2 | 1 | 4 | 3 | 2 |
| CR SPEED [inch/S] | 25 | 25 | 12.5 | 12.5 | 50 | 37.5 | 50 |
| ONE-SCAN TIME t1 [S] | 0.3 | 0.3 | 0.6 | 0.6 | 0.15 | 0.2 | 0.15 |
| LUMP U/D TIME t2 [s] | 0.13 | 0.13 | 0.065 | 0.065 | 0.26 | 0.195 | 0.26 |
| ONE-SCAN TOTALLY REQUIRED TIME [s] | 0.86 | 1.72 | 1.33 | 0.665 | 1.64 | 1.185 | 0.82 |

| | REFERENCE CONDITION | A | B | B′ | C | C′ | D |
|---|---|---|---|---|---|---|---|
| | 25″ / s TWO PASSES | duty × 1/2 (NUMBER OF PASSES × 2) | CR SPEED × 1/2 | CR SPEED × 1/2 (NUMBER OF PASSES × 1/2) | CR SPEED × 2 (NUMBER OF PASSES × 2) | CR SPEED × 1.5 (NUMBER OF PASSES × 1.5) | CR SPEED × 2 (NUMBER OF PASSES IS UNCHANGED) |
| NUMBER OF PASSES | 2 | 4 | 2 | 1 | 4 | 3 | 2 |
| CR SPEED [inch/S] | 25 | 25 | 12.5 | 12.5 | 50 | 37.5 | 50 |
| ONE-SCAN TIME t1 [S] | 0.3 | 0.3 | 0.6 | 0.6 | 0.15 | 0.2 | 0.15 |
| LUMP U/D TIME t2 [s] | 0.13 | 0.13 | 0.065 | 0.065 | 0.26 | 0.195 | 0.26 |
| ONE-SCAN TOTALLY REQUIRED TIME [s] | 0.86 | 1.72 | 1.33 | 0.665 | 1.64 | 1.185 | 0.82 |

FIG.5A

CR SPEED [inch/s]

| AVERAGE EJECTION FREQUENCY [kHz] | 6.25 | 12.5 | 25 | 37.5 | 50 |
|---|---|---|---|---|---|
| 7.5 | ○ | B′ 2 PASS ○~△ | A 4 PASS ○ | ○ | ○ |
| 10 | △~× | △ | ○~△ | C′ 3 PASS ○ | ○ |
| 15 | – | B′ 1 PASS △ | 2 PASS △ | ○ | C 4 PASS ○ |
| 22.5 | – | × | × | △ | ○ |
| 30 | – | – | × | × | D 2 PASS △ |

FIG.6

| AVERAGE TONE MAXIMUM VALUE (Md) | 0 ~ 85 | 86 ~ 170 | 171 ~ 255 |
|---|---|---|---|
| NUMBER OF PASSES | 2 | 3 | 4 |
| CR SPEED | 25″/s | 37.5″/s | 50″/s |

FIG.10

| PRINT DENSITY MAXIMUM VALUE | 0 ~ 25 % | 25 ~ 50 % |
|---|---|---|
| NUMBER OF PASSES | 2 | 4 |
| CR SPEED | 25"/s | 50"/s |

INK JET PRINTING APPARATUS AND INK JET PRINTING METHOD

BACKGROUND OF THE INVENTION

1. Field of the Invention

The present invention relates to an ink jet printing apparatus that forms an image on a print medium by use of a print head to eject ink from a plurality of printing elements arranged with density. More particularly, the invention relates to a method of controlling a print head of a serial-type ink jet printing apparatus that ejects ink while scanning the print head relative to the print medium.

2. Description of the Related Art

In the serial-type ink jet printing apparatus, an image is to be formed by alternately performing main scan for the carriage mounting a print head to make a printing while scanning parallel with a surface of a print medium and conveyance operation to feed the print medium in a direction transverse to the main scan. On the print head applicable for such a printing apparatus, a multiplicity of printing elements are arranged at a predetermined arrangement density in a direction transverse to the main scan in order to eject ink depending upon print information.

Japanese Patent Laid-Open No. S54-51837 discloses an ink jet print head of a scheme to eject ink by utilization of thermal energy. According to the print head in the document, each of its printing elements is structured with ejection ports through which ink is to be ejected, an ink path for guiding ink to a vicinity of the ejection ports, and an electrothermal conversion element (heater) arranged in the ink path. By applying a voltage pulse to the electrothermal conversion elements depending upon image data, film boiling is caused in the ink contacting therewith. By the growth action of bubbles produced, droplets are ejected through the ejection ports.

Meanwhile, Japanese Patent Laid-Open No. H5-330066 discloses a novel structure of a print head that is further increased in the arrangement density of the printing elements and capable of ejecting ink droplets in a slight amount at high frequency with the utilization of thermal energy similarly to Japanese Patent Laid-Open No. S54-51837, in order to meet the requirement to output a precise image at high speed. Recently, image output has been available with high definition at high speed but less granularity by adopting the structure as disclosed in Japanese Patent Laid-Open No. H5-330066.

However, it is confirmed that an air flow occurs between the print head and the print medium and has an effect upon the direction of ejecting ink droplets, on the print head arranged densely with individual print elements and capable of ejecting small droplets of ink at high frequency. Specifically, out of a plurality of printing element arrays arranged in a predetermined direction, there encounters a phenomenon that the ink, ejected from the printing element located close to an end thereof, is deflected toward a printing element located centrally.

FIG. 1 is a figure for typically explaining the adverse effect upon an image. This illustrates a print state on a print medium where a uniform image is printed by performing print scan once. The ink droplet, ejected from an ejection port located at the end of the print head, deflects in a manner attracted toward the center and arrives at the print medium, with a result that tone value is higher centrally than that at the end region. The image area thus formed, if continued in the sub-scan direction, raises a band-like tone unevenness over the entire image. From now on, such phenomenon is referred to as end-deviation phenomenon, for the sake of convenience.

The degree of such end-deviation phenomenon increases with the increase of the arrangement density of printing elements on the print head, with the increase of drive frequency and with the decrease of ejection volume (droplet volume). Meanwhile, it is also under the influence of the carriage moving speed and the distance between a print medium and an ejection-port formed surface (hereinafter, referred to as head-medium distance).

However, such ink deflection as to cause an end deviation can be suppressed to a certain extent by adopting a multi-pass printing method. The multi-pass printing method refers to a method that the print data, which can be printed by performing one print scan of the print head, is divided into a plurality of print scans, thereby completing an image phase by phase. The adoption of the multi-pass printing method reduces the print data for performing one main print scan, thus making it possible to reduce the substantial drive frequency to the print head and to suppress the occurrence of end deviations. As the number of multi-pass, i.e., the number of divisions of data which can be printed by performing one main print scan, increases, the reduction effect of end-deviation phenomenon can be obtained to a greater extent.

Japanese Patent Laid-Open No. 2002-096455 discloses a printing method to make such an end-deviation phenomenon inconspicuous with further actions. The multi-pass printing method usually uses a mask pattern defining the permission/non-permission to print in pixel in order to define the position of the data permitted to print by performing one main print scan. Japanese Patent Laid-Open No. 2002-096455 discloses a mask pattern in which the print permission ratio, corresponding to the printing element located closer to the end, is suppressed lower than the print ratio corresponding to the printing element located centrally. The use of such a mask pattern makes it possible to output an image excellent in uniformity through the effect to actively suppress the ejection frequency at a printing element ready to cause ink droplet deviation, in conjunction with the effect of the usual multi-pass printing method.

However, in the multi-pass printing method, the area which can be printed by performing print main scan once is completed by a plurality of cycles of print scans, thus increasing the time required in printing and incurring the lowering of throughput.

SUMMARY OF THE INVENTION

The present invention can provide an ink jet printing method in which end-deviation phenomenon is suppressed in a state not to reduce throughput to a possible extent.

The first aspect of the present invention is an ink jet printing apparatus for forming an image on a print medium by intermittently repeating a main scan to move a print head relative to the print medium and a sub-scan to convey the print medium in a direction transverse to the main scan, the print head being structured with printing elements arranged in plurality to print dots on the print medium depending upon image data, the apparatus comprising: a sensing device which senses print density information about dots from the image data; a setting device which sets a speed of the main scan and a number of times of the main scans over a same image area of the print medium, depending upon the print density information; and a printing device which prints an image on the print medium in accordance with the set scan speed and number of times of scans, wherein the setting device sets the number of times of scans greater and the scan speed higher as the print density information is greater in value.

The second aspect of the present invention is an ink jet printing method for forming an image on a print medium by intermittently repeating a main scan to move a print head relative to the print medium and a sub-scan to convey the print medium in a direction transverse to the main scan, the print head being structured with printing elements arranged in plurality to print dots on the print medium depending upon image data, the method comprising the steps of: sensing print density information about dots from the image data; setting a speed of the main scan and a number of times of the main scans over a same image area of the print medium, depending upon the print density information; and printing an image on the print medium in accordance with the scan speed and number of times of scans set, wherein the setting step sets the number of times of scans greater and the scan speed higher as the print density information is greater in value.

Further features of the present invention will become apparent from the following description of exemplary embodiments (with reference to the attached drawings).

BRIEF DESCRIPTION OF THE DRAWINGS

FIGS. 5A and 5B are figures for explaining the effect upon print time where the average ejection frequency of the print head and the scan speed of the carriage are varied together with the variation of the number of multi-pass relative to a reference condition;

FIG. 6 is a figure for explaining the degree of end-deviation phenomenon where a uniform image is printed by variously distributing conditions with reference to the reference condition;

FIG. 10 is a figure for explaining a content of a table stored in a ROM;

DESCRIPTION OF THE EMBODIMENTS

First Embodiment

Figure 2:
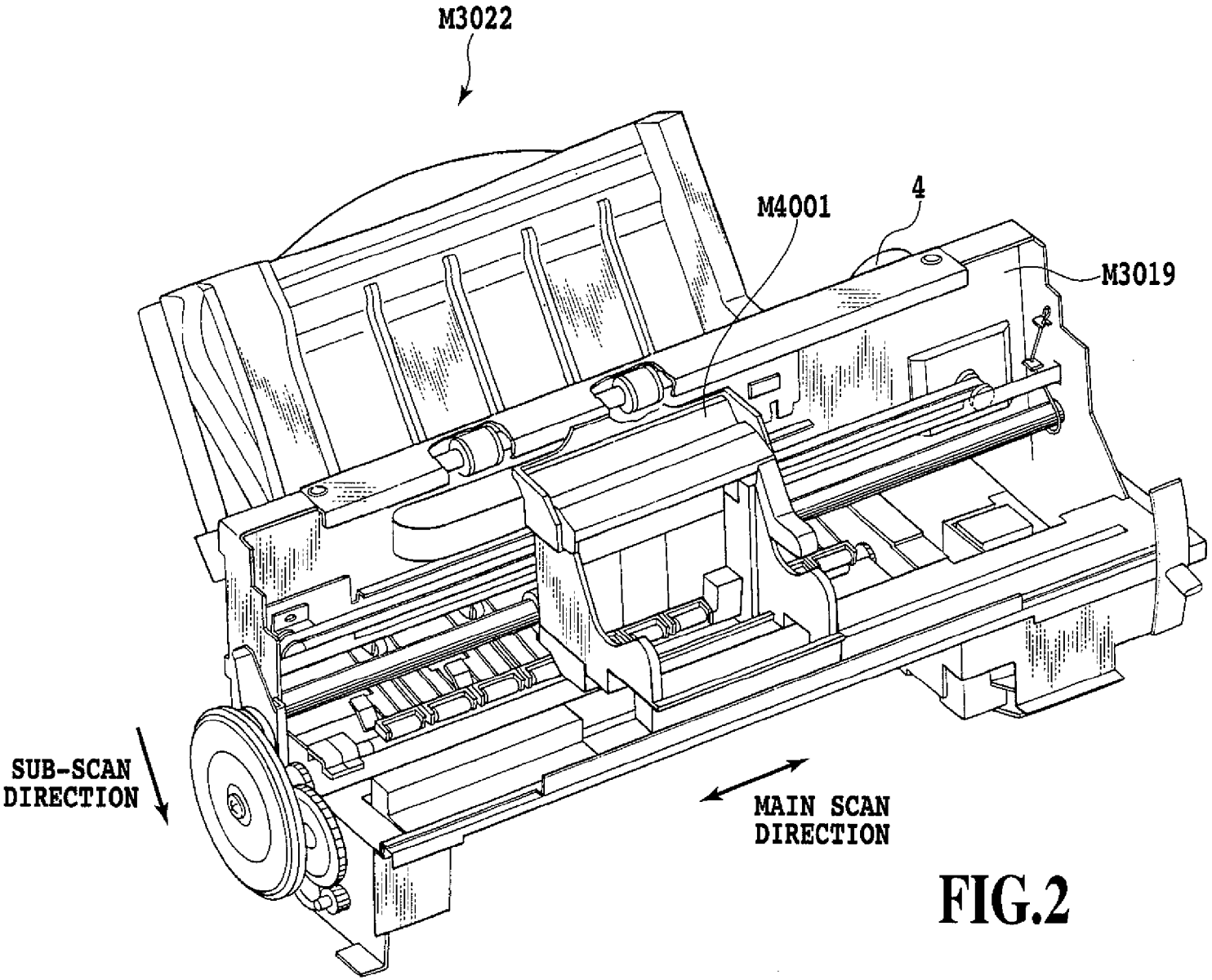
FIG. 2 is a structural view for explaining the internal mechanism of an ink jet printing apparatus applicable to an embodiment of the present invention.

FIG. 2 is a structural view for explaining the internal mechanism of an ink jet printing apparatus to be applied to the present embodiment. The main internal mechanism of the apparatus main body is set up and protected within a chassis M3019. M4001 is a carriage, which is arranged, in a state mounting thereon a print head cartridge (not shown), to reciprocate in a main scan direction in the figure by means of the drive force of a carriage motor 4. When inputting a print command, one sheet of a stack of print mediums on a paper feeding section M3022 is fed in a sub-scan direction to a site for printing with the print head cartridge mounted on the carriage M4001. Then, by intermittently repeating a main scan for the print head to eject ink in accordance with image data while moving the carriage M4001 in the main scan direction and a conveyance of the print medium in the sub scan direction (in a direction intersecting with main scan) by conveying means, images are formed in order on the print medium. The print head cartridge, in the embodiment, includes a print head H1000 capable of ejecting ink in the form of a droplet and ink tanks for supplying ink to the print head H1000.

Figure 3:
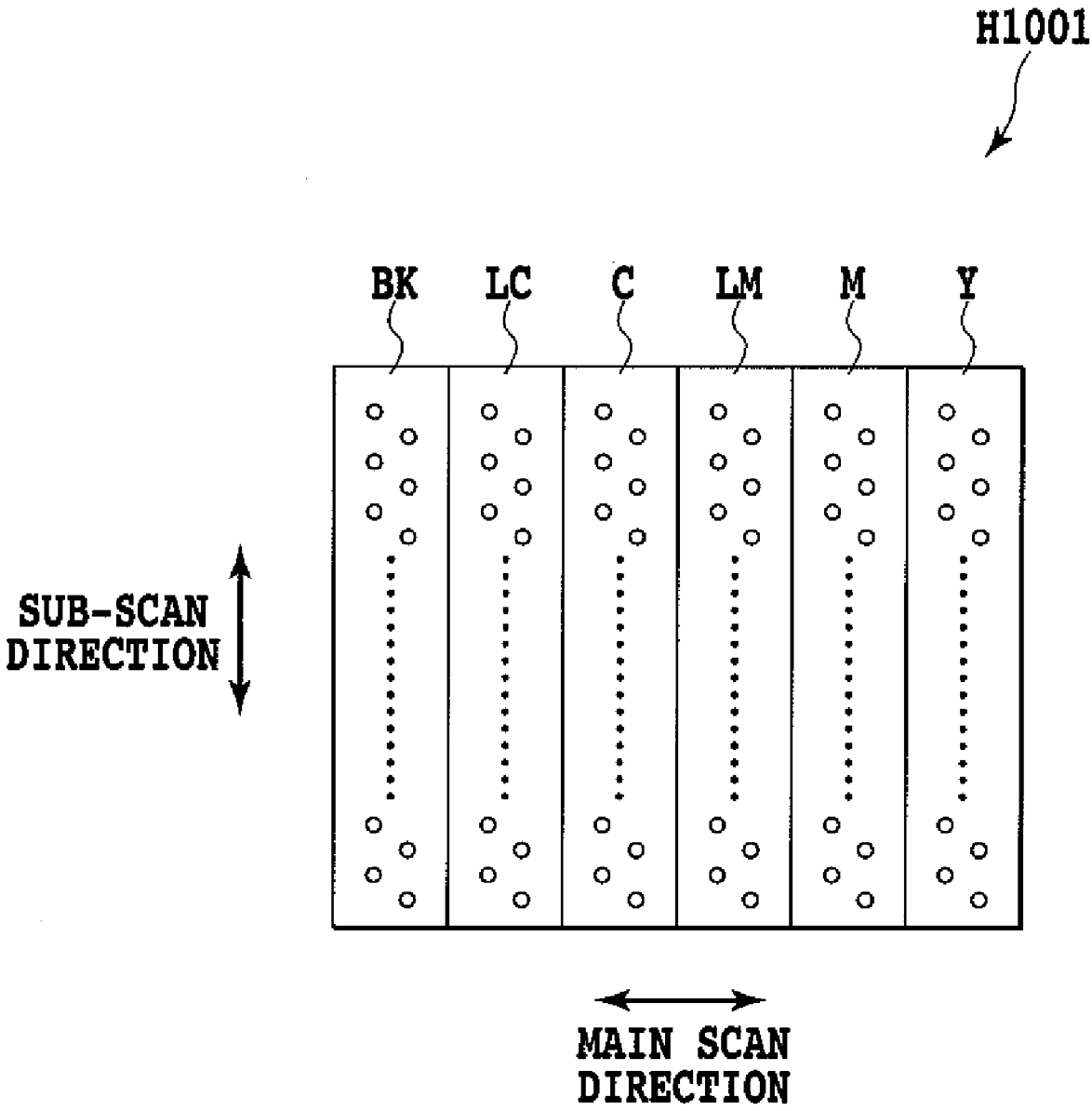
FIG. 3 is a plan view of a print head applicable to the embodiment of the invention, as seen from the side of an ejection-port formed surface.

FIG. 3 is a plan view of the print head H1000 according to the embodiment, as seen from the side of an ejection-port formed surface. In the print head H1000 according to the embodiment, six arrays of ejection ports (printing element arrays) are arranged in plurality in the main scan direction in order to eject six colors of ink. Those respectively correspond to black (Bk), light cyan (LC), cyan (C), light magenta (LM), magenta (M) and yellow (Y) inks. By ejecting the inks at a predetermined frequency through the ejection ports while moving the print head H1000 in the main scan direction, dots are printed at a print density of 1200 dpi (dots/inch) on the print medium.

Figure 4:
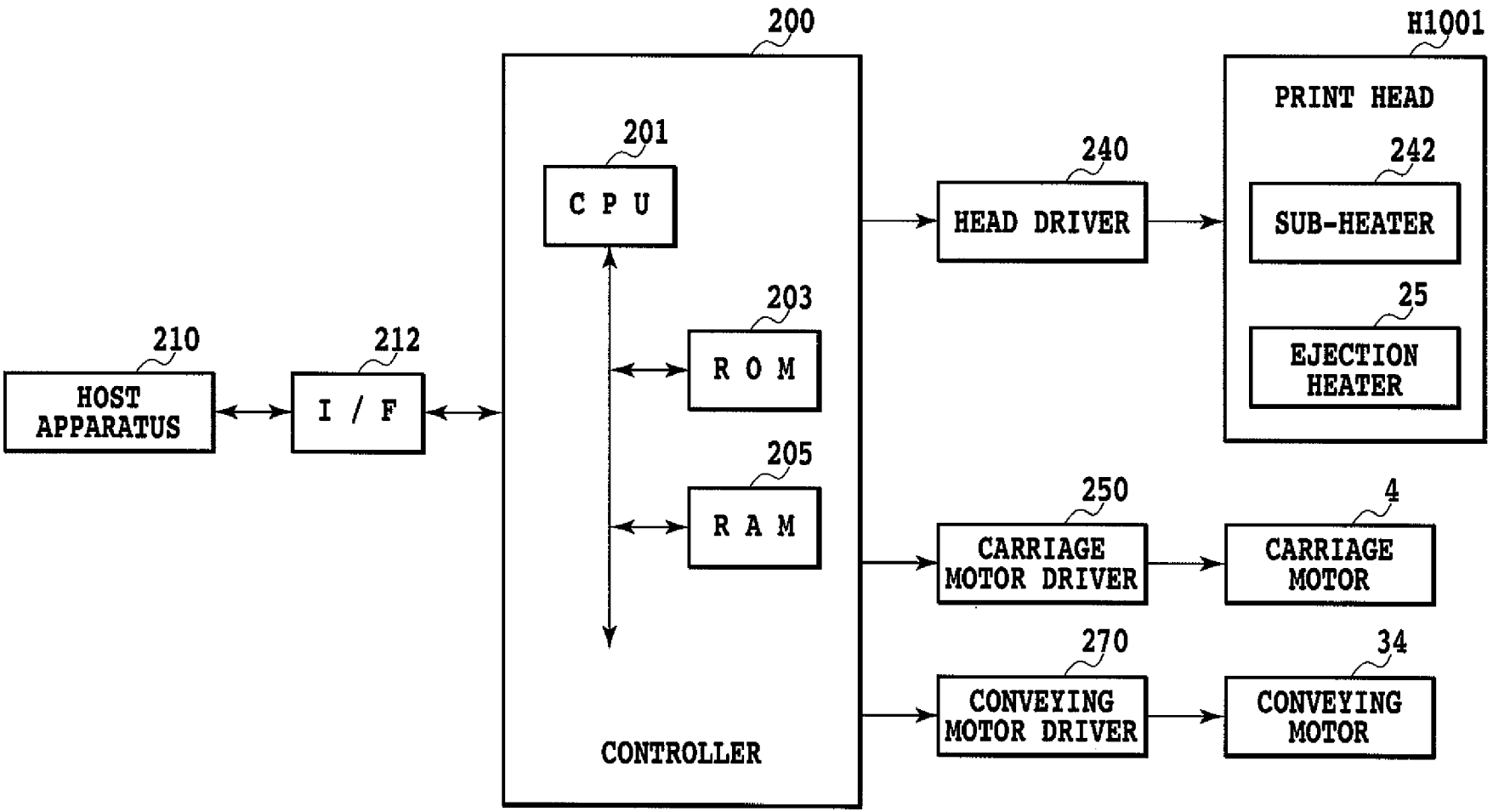
FIG. 4 is a block diagram for explaining a control arrangement of a printing apparatus applicable to the embodiment of the invention.

FIG. 4 is a block diagram for explaining the control arrangement of the printing apparatus according to the present embodiment. 200 is a controller taking control of the apparatus overall by acquiring information from the mechanisms of the apparatus and sending commands to them. In the controller 200, there are provided a ROM 203 to store various programs and a RAM 205 to be used as a work area for the CPU 201, in addition to a CPU 201. The ROM 203 stores tables and fixed data required in print control, besides the foregoing programs. For image tone value and print density for realizing the invention, tables of the number of multi-pass and carriage speed are also stored in the ROM 203.

A host apparatus 210 connected externally of the printing apparatus is a supply source of image data. Alternatively, it may be in the form of an image reader, etc., besides provided as a computer for creating, processing or so data, such as an image related to printing. Image data, other commands, status signals and the like are to be communicated with the controller 200 by way of an interface (I/F) 212. On the printing apparatus of this embodiment, the image data to be sent from the host apparatus 210 to the controller 200 is of a 600-ppi (pixels/inch) multi-valued signal while the image data to be printed by the print head H1000 onto a print medium is of a 1200-dpi binary signal. Namely, upon printing, the controller 200 executes image processing to convert a 600-ppi multi-valued signal into a 1200-dpi binary signal.

A head driver 240 is a driver that drives an electro-thermal converter (heater) 25 of the print head H1000 according to binary printing data. The print head H1000 is also provided with a sub heater 242 for heating up the print head to a proper temperature.

A carriage motor driver 250 is a driver that drives a carriage motor 4 to move the carriage M4001. A conveying motor driver 270 is a driver that drives a conveying motor 34 to feed a print medium in the sub-scan direction.

Now the characterizing matter in the embodiment is explained. Although the printing apparatus in the embodiment is capable of printing dots at a density of 1200 dpi, print density (print tone value) is not always high in the usual image. There are a deep-colored image that is comparatively high in print density and a light-colored image that is low in print density. Namely, edge-deviation phenomenon is conspicuous in some images but not conspicuous in other images. Under such a situation, it is a practice to reduce the ejection frequency for the print head by dividing image data with a sufficient number of multi-pass to a degree not to cause an end-deviation phenomenon regardless of an image to print, in the existing multi-pass printing method as described, for example, in Japanese Patent Laid-Open No. 2002-096455. Specifically, there are cases to employ 4 passes of a multi-pass printing method on every image based on a print density taken as a reference under more strict conditions even for such an image that end deviation is to be fully prevented by 2 passes of multi-pass.

The present inventors have noticed the above point and concluded that, in order to improve throughput while suppressing against end deviation, it is effective to previously acquire a print density of an image so that the number of multi-pass is not increased greater than that required when the print density is of a degree not concerned about the occurrence of end deviation. Furthermore, it has been also concluded to be effective to increase, if possible, the scan speed of the carriage to such a degree that end deviation is not conspicuous even where the number of multi-pass is set high.

Figure 5B:
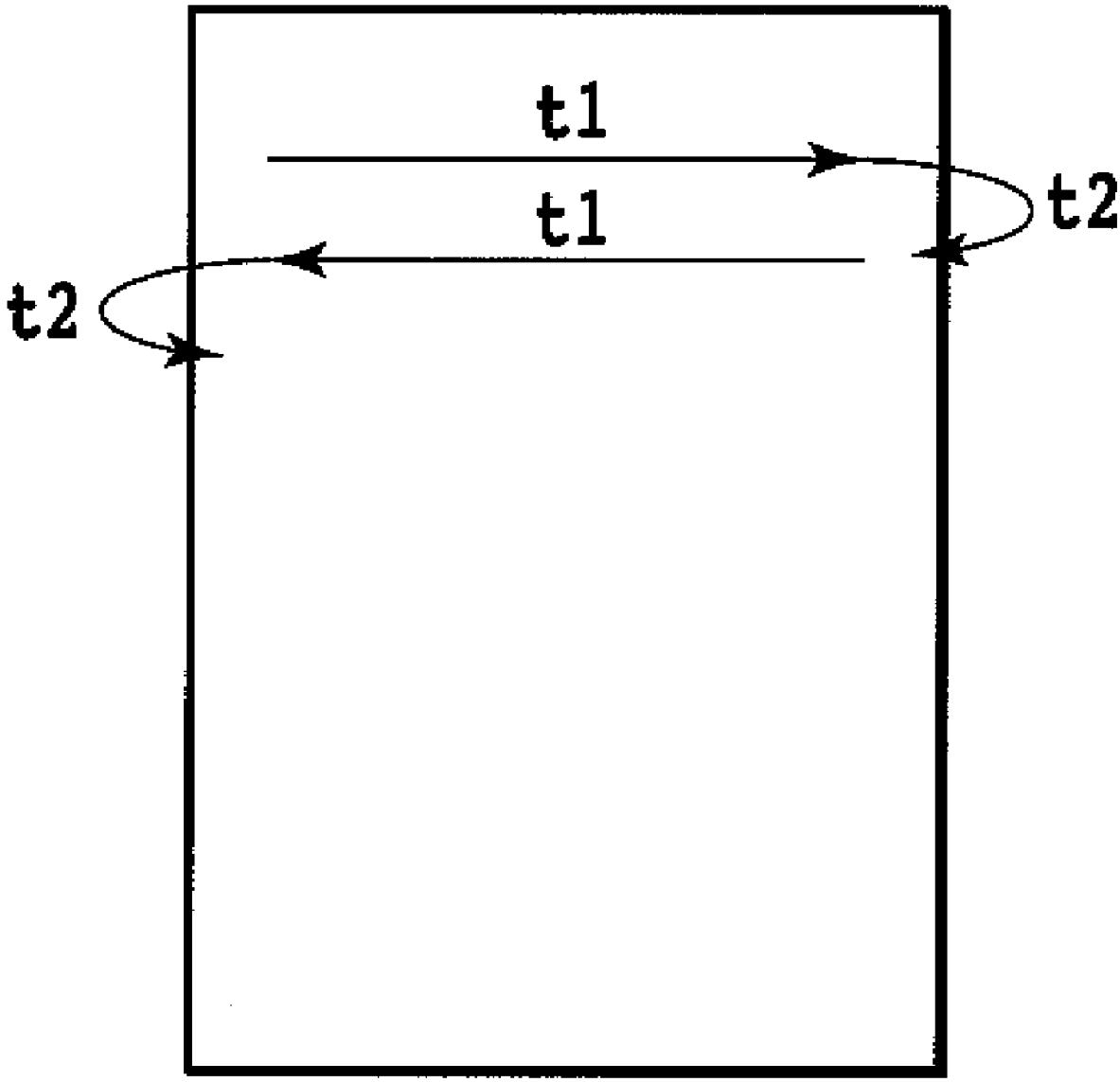

FIGS. 5A and 5B are figures for explaining the effect upon print time in the case the average ejection frequency of the print head and the scan speed of the carriage are changed relatively to the reference condition together with a change in the number of multi-pass, i.e., the number of print scans over the same image area. The reference condition, in this case, represents a condition shown in the extreme left column in FIG. 5A, i.e., 2 passes in a multi-pass print are performed bidirectionally at a carriage speed of 25 inches/second. In the table, one-scan time represents a time t1 required for performing scan once over a widthwise area of a print medium, referring to FIG. 5B. Meanwhile, lump U/D time represents a time t2 required for the carriage moving at a predetermined uniform speed to decelerate, stop and accelerate reverse in direction to the predetermined speed. This value varies depending upon the carriage speed t1. Furthermore, one-scan totally required time represents a time required for performing one reciprocation of main scan in two-pass printing by the carriage, or a time required for completing an image area, which is completed by one reciprocation of 2 passes, in the other number of multi-pass (P). For example, for 4-pass (P) print, the value is given by a multiplication of 4/2=2 (P/2) on the one-scan totally required time as to 2 passes because the area, to be completed by twice scans by 2 passes, is completed by four times (P) of print scans.

In FIG. 5A, condition A shows a case that the number of multi-pass is changed to 4 while maintaining the carriage speed equal to that of the reference condition. Because the number of scans is double that of the reference condition, the one-scan totally required time is also doubled. Condition B shows a case that the carriage speed is reduced to a half while maintaining the number of multi-pass equal to that of the reference condition. The one-scan totally required time is increased as compared to that of the reference condition correspondingly to the reduction of carriage speed. Condition B shows a state that the number of multi-pass is changed to 1 wherein the carriage speed is reduced to a half in order not to change the ejection frequency of the print head from that of the reference condition. Although the carriage speed is reduced, the one-scan totally required time is reduced as compared to that of the reference condition by the effect the number of multi-pass is reduced. Condition C shows a case that the number of multi-pass is changed to 4 and the carriage speed is doubled at the same time. Although the one-scan totally required time is increased correspondingly to the increase of the number of multi-pass, it is suppressed to less than that of case A because the carriage speed is increased at the same time. Meanwhile, condition C' shows a state that the number of multi-pass is increased to 3 and the carriage speed is increased to 3/2 times at the same time. Although the one-scan totally required time is increased correspondingly to the increase of the number of multi-pass, it is not increased up to 3/2 times that of the reference condition because the carriage speed is also increased. Furthermore, condition D shows a case that the carriage speed is doubled while maintaining the number of multi-pass as it is. Although the one scan time is halved correspondingly to doubling the carriage speed, there is no significant difference in the one-scan totally required time from that of the reference condition because the lump U/D time increases as the carriage becomes higher in speed.

FIG. 6 is a figure for explaining the degree of end-deviation phenomenon where printing a uniform image by distributing various conditions relatively to the reference condition as in the foregoing. In the figure, carriage scan speed is taken horizontally wherein five levels of speeds are provided around 25 inches/second. Meanwhile, average ejection frequency per ejection port array is taken vertically wherein five levels of frequencies are provided at 7.5 to 30 KHz. The average ejection frequency is of a value determined by the number of multi-pass and carriage speed in printing the uniform image. For the conditions, the state that the adverse effect of end-deviation phenomenon is not conspicuous is marked with "○", the state that end-deviation phenomenon is not so conspicuous but confirmed is with "Δ", and the state that the adverse effect of end-deviation phenomenon is conspicuous is marked with "x".

The reference condition explained in FIG. 5A is shown centrally in the table wherein end deviation is evaluated as "Δ". Meanwhile, conditions A-D provided by distributing conditions in six ways relatively to the reference condition are indicated with respective symbols in the table. For example, for the condition A, the one-scan totally print time is increased but the end-deviation phenomenon is not conspicuous correspondingly to the increased number of multi-pass and the halved average ejection frequency. For the condition B, although the number of multi-pass is not changed, the one-scan total print time is increased correspondingly to a decrease in the carriage speed, the end-deviation phenomenon is not so conspicuous because of the decrease in the average ejection frequency. However, according to the understanding of the present inventors, image quality is considered in a degree not satisfactory. For the condition B', because the carriage speed is decreased but the number of multi-pass is decreased to 1, the average ejection frequency is not different in value from that of the reference condition and hence the end-deviation phenomenon is not improved. For the condition C, because the carriage speed is increased together with the number of multi-pass, the average drive frequency is not different from that of the reference condition. However, the adverse effect of end deviation is dispersed correspondingly to the increase of the number of multi-pass from 2 to 4, thus obtaining an image preferable rather than that under the reference condition. For the condition C', the average drive frequency is provided lower than that of the reference condition by an increase of the number of multi-pass and carriage speed. Accordingly, the end deviation is improved in degree by a decrease of the average drive frequency and an increase of the number of multi-pass. For condition D, because the carriage speed is increased with the number of multi-pass being maintained as it is, the average ejection frequency is increased, thus not improving the end-deviation phenomenon in degree.

From the evaluation result shown in FIGS. 5A and 6, the present inventors concluded that it is effective to provide a structure to print an image within a range that end-deviation phenomenon is allowable in quality (i.e., under a condition evaluated as "○") and under a condition that throughput is expected to improve to a possible extent. However, the average ejection frequency shown in FIG. 6 varies with the print density of an image to print, in addition to the number of multi-pass and carriage speed. Accordingly, as stated above, the present embodiment is provided with means for previously acquiring an in-page print density so that a combination of the number of multi-pass and a carriage speed can be selected not to cause an end deviation, in accordance with a print density obtained.

Figure 7:
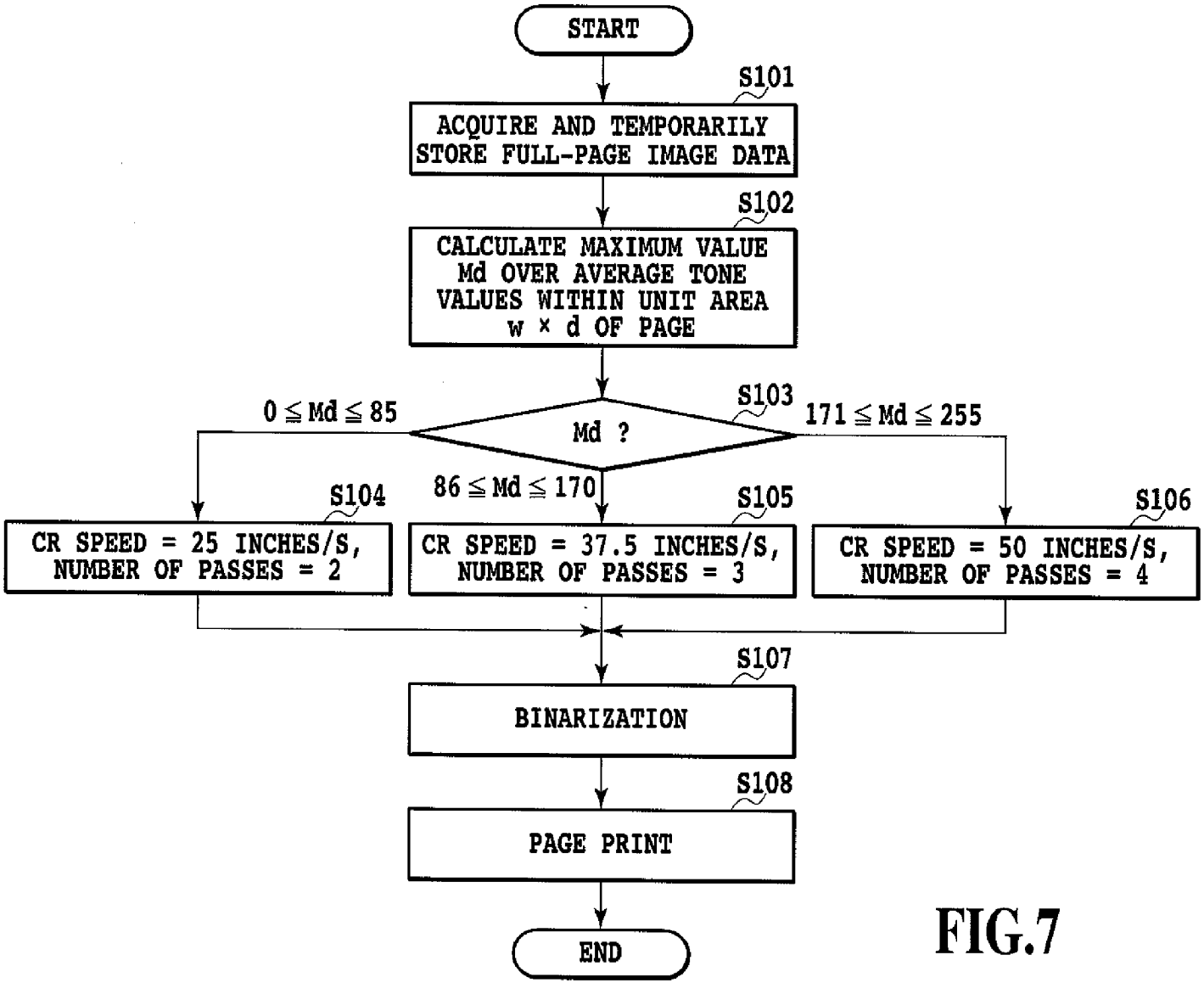
FIG. 7 is a flowchart for explaining a print control process in a first embodiment.

FIG. 7 is a flowchart for explaining a print control process to be executed by the controller 200 of the printing apparatus of the present embodiment. When a print command is inputted from the host apparatus 210, the controller 200, in step S101, first acquires full-page image data and temporarily stores it on an ink-color basis in the RAM 205. The image data, stored at this time, is 600-ppi tone data that each pixel is to be represented at 0-255. This represents that the numerical value is greater as the tone value is higher, i.e., the print density is higher. Thereafter, the process proceeds to step S102, to acquire an average-tone maximum value Md over the page.

Figure 8B:
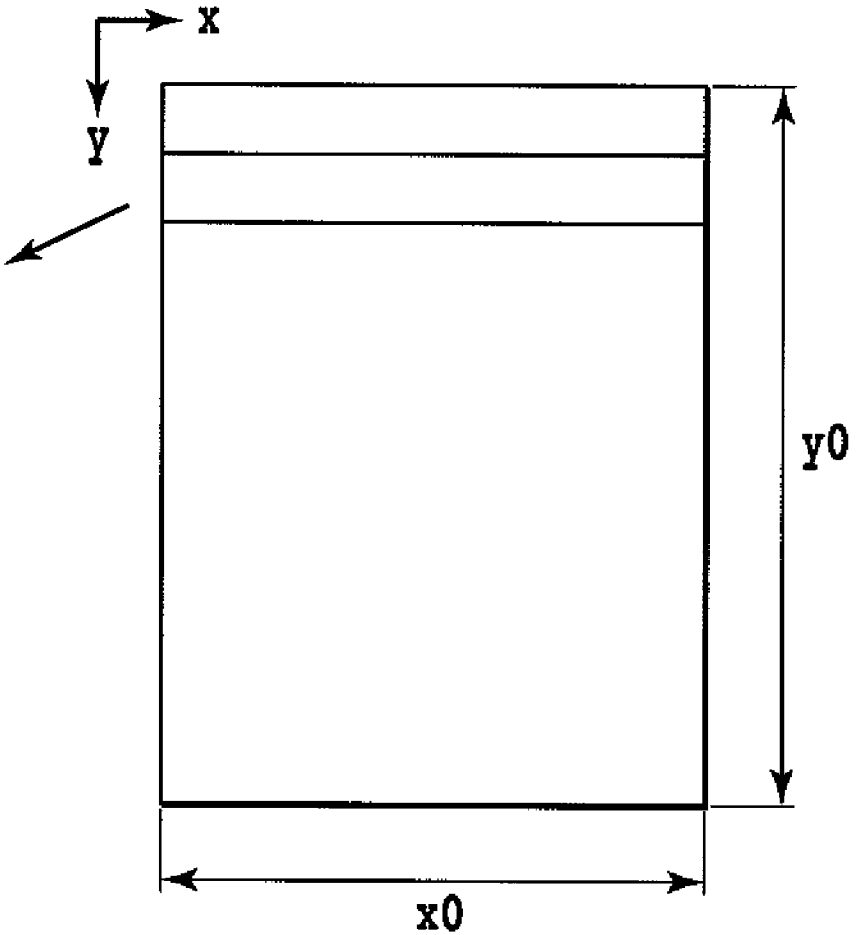
FIGS. 8A and 8B are schematic diagrams for explaining a calculation method for an average-tone maximum value Md in the first embodiment.
Figure 8A:
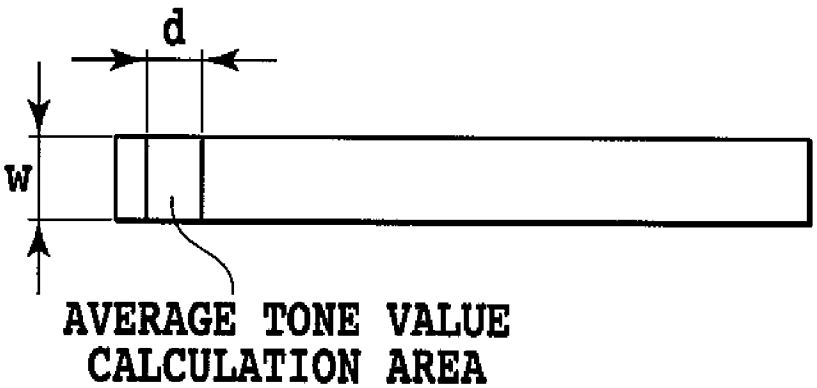

FIGS. 8A and 8B are schematic diagrams for explaining a method of calculating an average-tone maximum value Md in the present embodiment. FIG. 8B is a schematic diagram showing an image data area binarized at the step S102. In the present embodiment, such image data area is divided as unit areas each having d pixels×w pixels at 600 ppi and calculates an average tone value on each unit area. Namely, a tone value (0-255) is examined on each pixel included in the area having d pixels and w pixels, to determine an average value within the area. The greatest value of those included in all the unit areas of the page is assumed to be defined as an average-tone maximum value Md. In the figure, X0 represents the number of unit areas included widthwise within the image data with respect to the main scan direction while Y0 represents the number of unit areas included widthwise within the image data with respect to the sub-scan direction.

Figure 9:
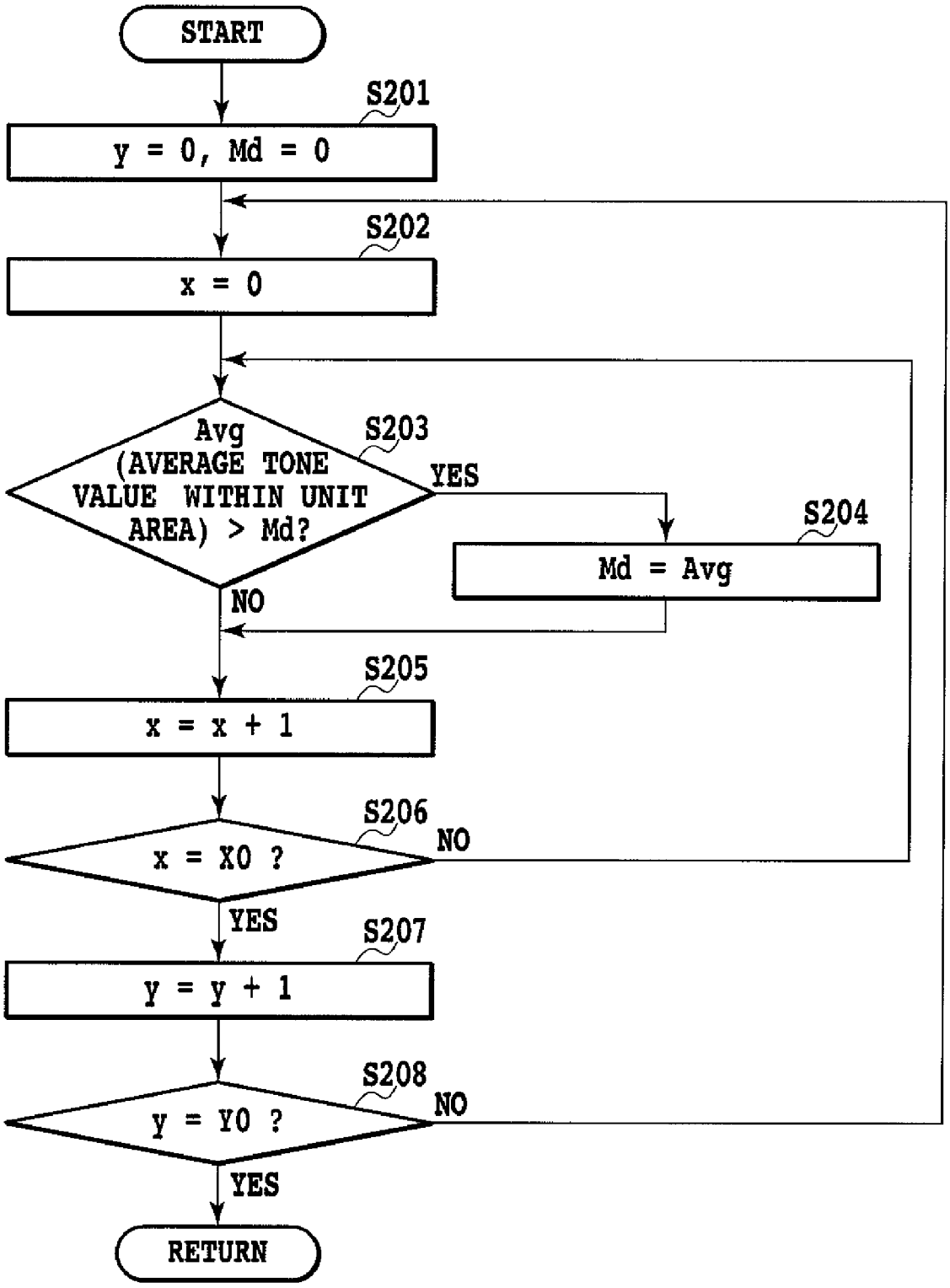
FIG. 9 is a flowchart for explaining a process to acquire a print-density maximum value Md in 1st embodiment.

FIG. 9 is a flowchart for explaining a process that the controller 200 acquires an average-tone maximum value Md at the step S102. At first, the controller 200 sets a variable y and Md at an initial value 0 (step S201). At the next step S202, the variable x is set at 0. Here, x is a variable for indicating the position of the unit area in the main scan direction while y is a variable for indicating the position of the same in the sub-scan direction.

At step S203, an average print tone value Avg is calculated on the unit area under consideration and compared with Md. Namely, tone values of all the pixels included in the unit area under consideration are acquired, the average value Avg of which is compared with an average-tone maximum value Md obtained currently. In the case of Avg>Md, the average tone value obtained from the unit area under consideration is determined as a current average-tone maximum value Md and the process proceeds to step S204 where Md=Avg is set. Meanwhile, in the case of Avg≦Md, the average-tone maximum value Md is determined satisfactory as it is and the process proceeds to step S205.

At step S205, x is incremented in order to shift the unit area under consideration by one in the main scan direction and the process proceeds to step S206. At the step S206, the parameter x is compared with X0. In the case of x=X0, the unit areas in a series arranged in the main scan direction are determined all detected and the process proceeds to step S207. Meanwhile, in the case of x≠X0, the process returns to the step S203 in order to detect an average tone value on the next unit area adjacent in the main scan direction.

At step S207, y is incremented in order to shift the unit area under consideration by one in the sub-scan direction and the process proceeds to step S208. At the step S208, the parameter y is compared with Y0. In the case of y=Y0, the unit areas in a series arranged in the sub-scan direction are determined all detected and the process returns to the step S103 of FIG. 7. Meanwhile, in the case of y≠Y0, the process returns to the step S202 in order to detect an average tone value on the next unit area adjacent in the sub-scan direction. The finally obtained Md in such a process is provided as a value representative of a maximum average tone value over all the in-page unit areas. Namely, the unit area having the average-tone maximum value, obtained here, is provided as an area that is highest in tone, highest in print density and concerned about an end-deviation phenomenon throughout the page. Accordingly, in case such a printing method is selected as to avoid end-deviation phenomenon in the relevant area, all the in-page areas can be avoided from end-deviation phenomenon.

Referring back to the flowchart of FIG. 7, after an average-tone maximum value Md is obtained at the step S102, the process proceeds to step S103. Then, the controller 200 branches the process depending upon whether the value Md is fallen within any of 0-85, 86-170 and 171-255. In the case of 0≦Md≦85, the process proceeds to step S104. In the case of 86≦Md≦170, the process proceeds to step S105. Furthermore, in the case of 171≦Md≦255, the process proceeds to step S106.

At steps S104-S106, the controller 200 looks up the table previously stored in the ROM 203, to set a carriage speed and the number of multi-pass correspondingly to each Md value.

FIG. 10 is a figure for explaining a content of the table stored in the ROM 203. In the case of 0≦Md≦85, set is 2-pass printing with a carriage speed of 25 inches/second. In the case of 86≦Md≦170, set is 3-pass printing with a carriage speed of 37.5 inches/second. Furthermore, in the case of 171≦Md≦255, set is 4-pass printing with a carriage speed of 50 inches/second. As a result, only when the value Md is comparatively low, i.e., print density of dots is low, the reference condition shown in FIG. 5A is set. As print density increases, a condition is set greater in the number of multi-pass and higher in carriage speed phase by phase, e.g., condition C' and then condition C.

After the carriage speed and the number of multi-pass are set at the step S104-S106, the process proceeds to step S107 where the controller 200 performs binarization on all the pixels in all colors stored at 600 ppi and converts those into 1200-dpi binary data. The binarization in this case can employ a known art, such as error diffusion or dithering. Furthermore, the process proceeds to step S108 where the controller 200 takes control of various drivers in accordance with the set number of multi-pass and carriage speed while transferring the binarized image data to the head driver, thereby printing an image in amount of one page on the print medium. By the above, the present process is completed.

As explained above, the present embodiment is to detect, as print density information, a maximum value of in-page tone value of an image to print and then set the number of multi-pass and carriage speed in accordance with the relevant value. This makes it possible to output a suitable image free from the occurrence of end deviation by means of a printing way optimal for each page without reducing the throughput to a required extent or more for a page not so high in image tone value.

Figure 1:
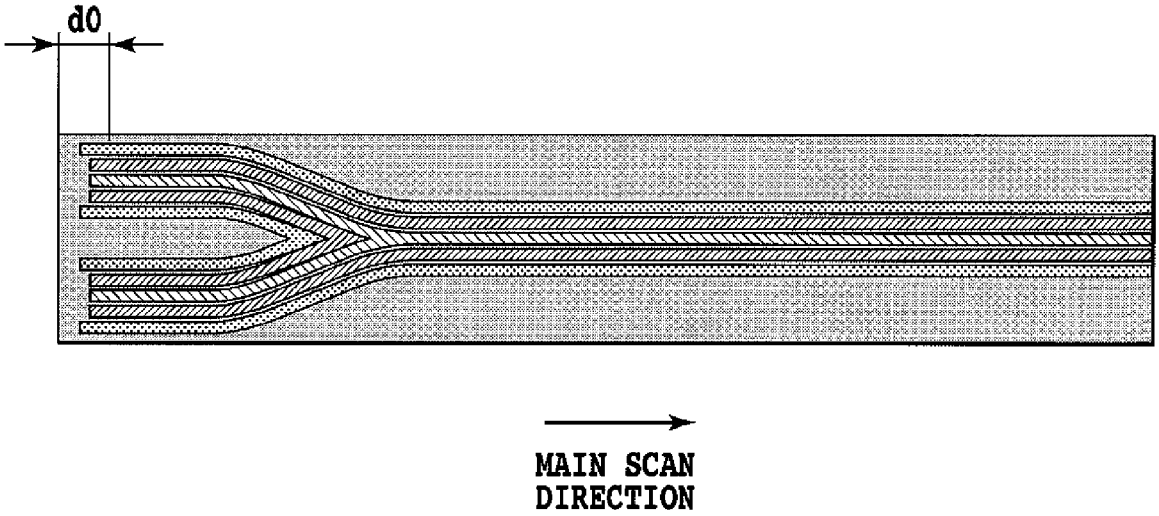
FIG. 1 is a view for typically explaining an end-deviation adverse effect.

Incidentally, the unit area d×w in the embodiment has a width w in the sub-scan direction that is suitably of a value corresponding to a printing width of the print head. However, the width d in the main scan direction is variable in accordance with the occurrence state of end-deviation phenomenon. Referring again to FIG. 1, the usual end-deviation phenomenon does not necessarily appear conspicuously at a print start point when the print head performs scanning in the main scan direction, i.e., it is a phenomenon that occurs as a result of performing continuous ejection in a certain degree and further producing an airflow after a start of print scan. Accordingly, the actual end-deviation phenomenon is to be confirmed at a point spaced some distance from a print scan start point. In this embodiment, because it is approximately 5 mm as a result of empirically determining the distance, the width d of the unit area is provided by 128 pixels corresponding to the width provided in terms of 600 dpi. This can avoid the occurrence of an end-deviation phenomenon at least in the scan over each of the unit areas.

Second Embodiment

A second embodiment according to the invention will now be explained. This embodiment is also applied with the printing apparatus and print head explained with FIGS. 2 to 4. Differently from the first embodiment, multi-valued brightness data in red (R), green (G) and blue (B) is inputted at 600 ppi from the host apparatus 210 to the printing apparatus of this embodiment. After various image processes executed by the controller 200, the number of multi-pass and carriage speed are assumed to be set from the print density of dots the binary tone-value data represents.

Figure 11:
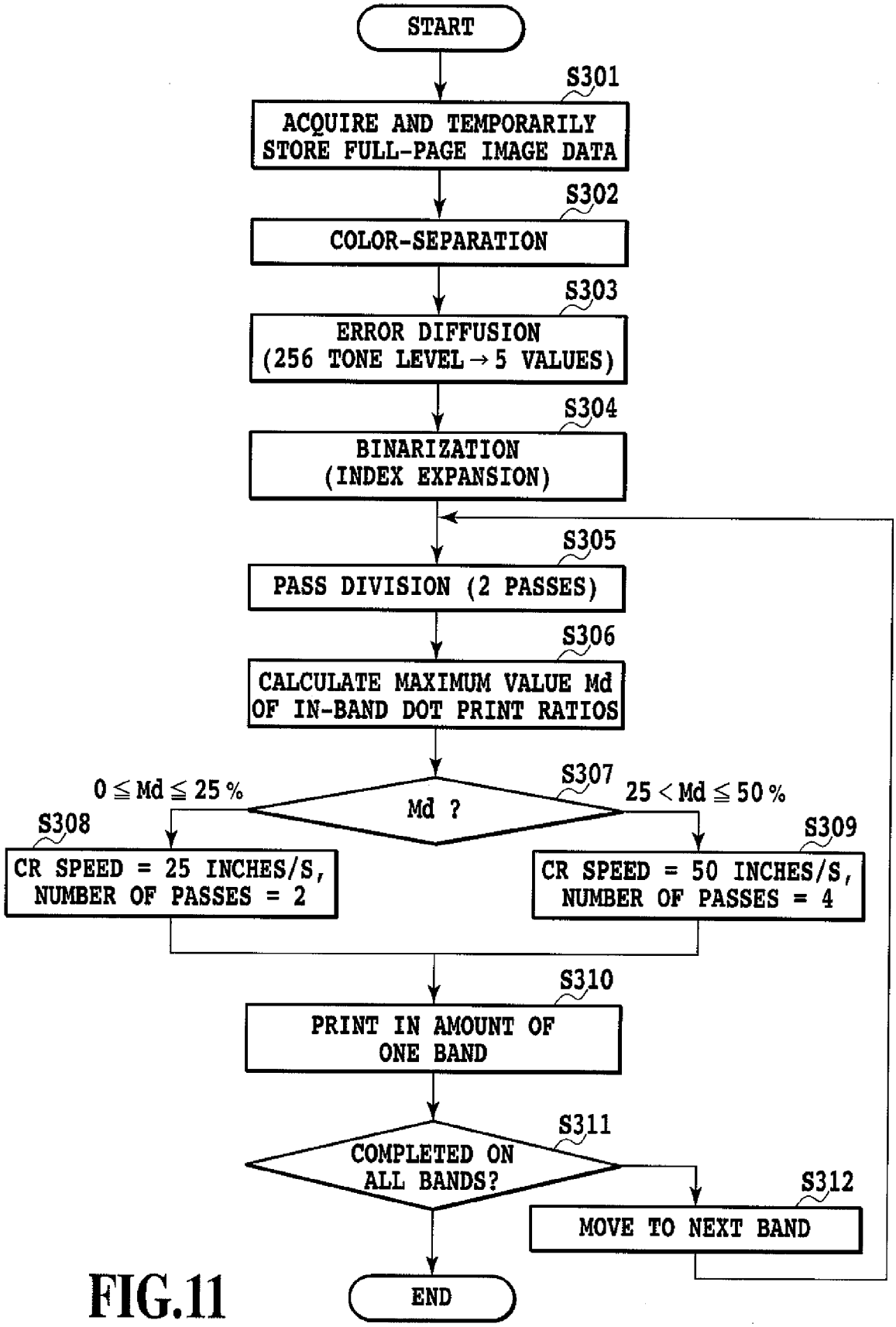
FIG. 11 is a flowchart for explaining a print control process in a second embodiment.

FIG. 11 is a flowchart for explaining a print control process to be executed by the controller 200 in the printing apparatus of the present embodiment. When a print command is inputted from the host apparatus 210, the controller 200, in step S301, first acquires full-page image data and temporarily stores it in the RAM 205. The image data, stored at this time, is 600-ppi brightness data (RGB) that each pixel is to be represented at 0-255.

At the next step S302, the controller 200 color-separates the stored brightness data (RGB) and converts it into tone-value data for six-color inks the printing apparatus uses. By the color separation, produced and stored are six colors (Bk, LC, C, LM, M, Y) of 600-ppi tone-value data representative of pixels at 0-255.

Furthermore, the process proceeds to step S303 where the 600-ppi 256-leveled tone-value data is converted into 600-ppi 5-valued (0-4) tone-value data by multi-valued error diffusion. Furthermore, at step S304, the 600-ppi 5-valued tone-value data is converted into 1200-dpi binary tone-value data. In this embodiment, the binarization in this case employs an index patterning process.

In the index patterning process, the tone values to be provided to the 600-dpi pixels are converted into a dot pattern corresponding to the respective tone vales. The one-pixel area taken in terms of 600 dpi corresponds to 2 pixels×2 pixels areas taken in terms of 1200 dpi wherein the pixels taken in terms of 1200 dpi are classified as pixels to print dots (1) and pixels not to print dots (0). Setting is made such that pixels to print dots gradually increase with increasing tone value. In this embodiment, the ROM 203 of the controller 200 is previously stored with a pattern thus associated with tone values. By looking up the pattern, the CPU 201 converts 600-dpi 5-valued data into 1200-dpi binary data.

Reference is made back again to FIG. 11. At step S305, out of binarized binary data in an amount of one page, the area to print in the next print scan is applied with a mask pattern for 2 passes and divided into two print scans. Specifically, dot data thinned-out to nearly a half is obtained for one scan by ANDing together the binary image data of one scan and the 2-pass mask pattern defining the permission/non-permission to print dots.

Figures 12, 13:
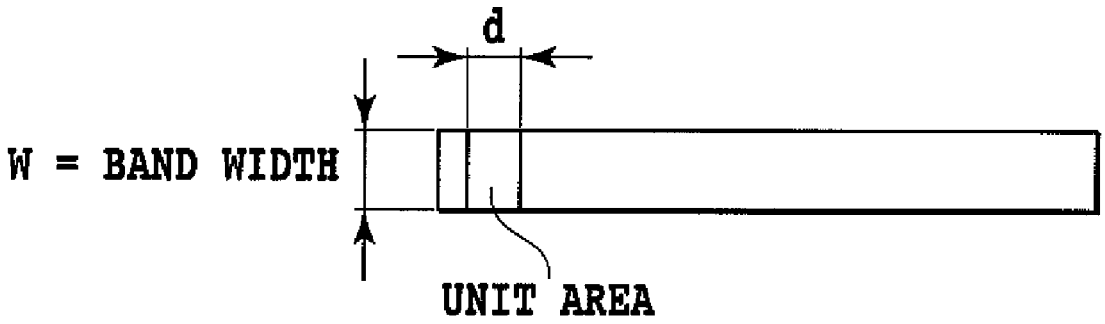
FIG. 12 is a schematic diagram for explaining a unit area (d×w)
FIG. 13 is a figure for explaining a content of a table stored in a ROM.

Furthermore, at step S306, the dot data area of one scan, which is obtained at the step S305, is detected on a unit-area (d×w) basis as shown in FIG. 12, to acquire a maximum value Md of dot print density within one scan.

The process for acquiring dot-print-density maximum value Md in the present embodiment can be outlined along the flowchart shown in FIG. 9 similarly to the first embodiment. However, in the present embodiment, the ratio of dots to print within the unit area (d×w) is assumed as a dot print density in the unit area wherein, at the step S203, the relevant value is compared with the currently-obtained print-density maximum value Md. Meanwhile, in the present embodiment, steps S207 and S208 are omitted because the number of multi-pass and carriage speed are to be varied on a print-scan basis and hence the sub-scan-directional variable y is not used.

After calculating the in-page print-density maximum value Md at the step S306, the process proceeds to step S307 where the controller 200 determines whether the print-density maximum value Md is fallen within a range of $0\% \leqq Md \leqq 25\%$ or within a range of $25\% < Md \leqq 50\%$. Because the dot data has been pass-divided for 2 passes at the step S305, the print-density maximum value Md is maximally as great as 50%. In the case of $0 \leqq Md \leqq 25$, the process proceeds to step S308 whereas, in the case of $25 < Md \leqq 50$, the process proceeds to step S309.

At steps S308 and S309, the controller 200 looks up the table previously stored in the ROM 203, to thereby set a carriage speed and the number of multi-pass correspondingly to each value Md.

FIG. 13 is a figure for explaining a content of the table stored in the ROM 203. In the case that Md lies within $0 \leqq Md \leqq 25$, set is 2-pass print with a carriage speed of 25 inches/second. Meanwhile, in the case that Md lies in $25 < Md \leqq 50$, set is 4-pass print with a carriage speed of 50 inches/second.

After setting the carriage speed and the number of multi-pass at the step S308 or S309, the process proceeds to step S310 where the controller 200 takes control of various drivers according to the set number of multi-pass and carriage speed, thereby making a printing of one band on the print medium.

Specifically, when multi-path printing is set with 2 passes at the step S308, the binary data obtained in the pass-division at the step S305 is printed as it is at a carriage speed of 25 inches/seconds. Meanwhile, when multi-pass print is set with 4 passes at the step S309, the binary data obtained in the pass division at the step S305 is divided further into two parts.

Figure 14A:
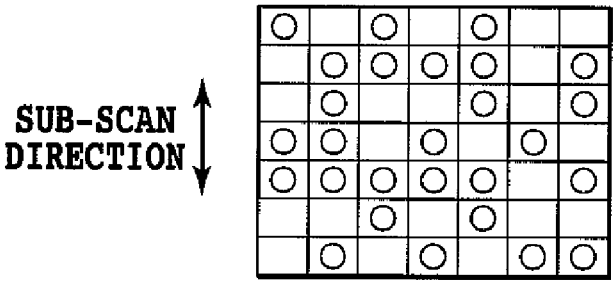
FIGS. 14A to 14C are figures for explaining the method to divide the image data, divided for 2-pass use, further into two parts.
Figure 14B:
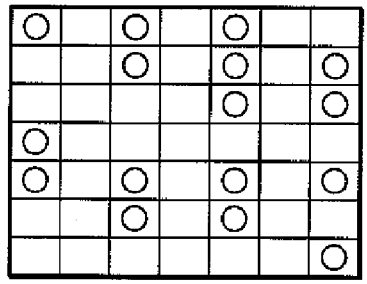
Figure 14C:
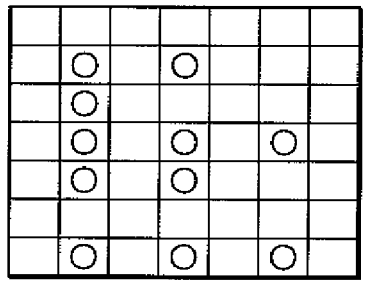

FIGS. 14A-14C are figures for explaining a manner to further divide, into two parts, the image data pass-divided for 2 passes. FIG. 14A is a schematic diagram fragmentary showing the image data divided for two passes at the step S305. In the figure, the area with "○" represents a 1200-dpi pixel for printing a dot. FIGS. 14B and 14C show a state that FIG. 14A is further divided into two parts. In this case, division is into two parts of image data in a manner arranging printed pixels every other pixel in the main scan direction.

In the case that multi-pass print is set with 4 passes at the step S309, the present embodiment is to print the two divisional parts of data, i.e., FIGS. 14B and 14C, by dividing two print scans. Even where the print head is allowed to realize a drive frequency corresponding to a carriage speed of 25 inches/second, the data if divided into two parts as shown in FIGS. 14A-14C can double the carriage speed without substantially changing the drive frequency of the print head. The 4-pass print mode, in this embodiment, realizes a carriage speed of 50 inches/second by use of the dividing method as shown in FIGS. 14A-14C.

When completing one band of printing with the set number of multi-pass and carriage speed, the print medium is fed in a predetermined amount in the sub-scan direction, followed by proceeding of the process to step S311. At the step S311, determination is made as to whether or not printing has been completed on all the bands in the page. When determined there remains a band to print, the process returns to step S305 where pass division is made on the next band area. Meanwhile, when determined at the step S311 that printing has been completed on all the bands, the present process is terminated.

According to the present embodiment, switching is available to multi-pass print with 4 passes that the carriage speed is set high only for a print scan over a scan area high in print density while using a multi-pass basic mode with 2 passes. As compared to the first embodiment determining the number of multi-pass depending on a maximum tone value in the page, an image can be outputted without the occurrence of an end deviation while effectively improving the throughput. Meanwhile, because the memory size is satisfactorily smaller than is required for the controller 200 to detect a dot-print-density maximum value Md as compared to the first embodiment that searches the whole area in the page, the apparatus can be realized at a lower cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-334730, filed Dec. 12, 2006, which is hereby incorporated by reference herein in its entirety.

What is claimed is:

1. An ink jet printing apparatus for forming an image on a print medium by intermittently repeating a main scan to move a print head relative to the print medium and a sub-scan to convey the print medium in a direction transverse to the main scan, the print head being structured with printing elements arranged in plurality to print dots on the print medium depending upon image data, the apparatus comprising:

a sensing device which senses print density information regarding dots from the image data;

a setting device which sets a speed of the main scan and a number of times of the main scans over a same image area of the print medium, depending upon the print density information; and a printing device which prints an image on the print medium in accordance with the set scan speed and number of times of scans, wherein said setting device sets the number of times of scans greater and the scan speed higher as the print density information is greater in value, and wherein said sensing device comprises a device for detecting an average value of a multi-value corresponding to the image data in a unit area in a range included in a predetermined area of a page and a device for selecting a maximum value out of detected average values and providing same as the print density information.

2. An ink jet printing apparatus according to claim 1, wherein the predetermined area is an entire image area of the page, said printing device prints an image on the entire image area of the print medium in accordance with one set of the scan speed and number of times of scans set by said setting device.

3. An ink jet printing apparatus according to claim 1, wherein the predetermined area is a scan area where an image is to be printed by one of the main scans, said printing device prints an image on the scan area in accordance with one set of the scan speed and number of times of scans set by said setting device.

4. An ink jet printing apparatus for forming an image on a print medium by intermittently repeating a main scan to move a print head relative to the print medium and a sub-scan to convey the print medium in a direction transverse to the main scan, the print head being structured with printing elements arranged in plurality to print dots on the print medium depending upon image data, the apparatus comprising:

a sensing device which senses print density information regarding dots from the image data;

a setting device which sets a speed of the main scan and a number of times of the main scans over a same image area of the print medium, depending upon the print density information, and a printing device which prints an image on the print medium in accordance with the setted scan speed and number of times of scans, wherein said setting device sets the number of times of scans greater and the scan speed higher as the print density information is greater in value; and wherein said sensing device comprises a device for detecting a print density of dots in a unit area in a range included in a predetermined area of a page and a device for selecting a maximum value out of detected print densities and providing same as the print density information.

5. An ink jet printing apparatus according to claim 4, wherein the predetermined area is an entire image area of the page, said printing device prints an image on the entire image area of the print medium in accordance with one set of the scan speed and number of times of scans set by said setting device.

6. An ink jet printing apparatus according to claim 4, wherein the predetermined area is a scan area where an image is to be printed by one of the main scans, said printing device prints an image on the scan area in accordance with one set of the scan speed and number of times of scans set by said setting device.

7. An ink jet printing method for forming an image on a print medium by intermittently repeating a main scan to move a print head relative to the print medium and a sub-scan to convey the print medium in a direction transverse to the main scan, the print head being structured with printing elements arranged in plurality to print dots on the print medium depending upon image data, the method comprising the steps of:

sensing print density information regarding dots from the image data;

setting a speed of the main scan and a number of times of the main scans over a same image area of the print medium, depending upon the print density information; and printing an image on the print medium in accordance with the scan speed and number of times of scans set, wherein said setting step sets the number of times of scans greater and the scan speed higher as the print density information is greater in value, and wherein said sensing step comprises detecting an average value of a multi-value corresponding to the image data in a unit area in a range included in a predetermined area of a page and selecting a maximum value out of detected average values and providing same as the print density information.

8. An ink jet printing method for forming an image on a print medium by intermittently repeating a main scan to move a print head relative to the print medium and a sub-scan to convey the print medium in a direction transverse to the main scan, the print head being structured with printing elements arranged in plurality to print dots on the print medium depending upon image data, the method comprising the steps of:

sensing print density information regarding dots from the image data;

setting a speed of the main scan and a number of times of the main scans over a same image area of the print medium, depending upon the print density information; and printing an image on the print medium in accordance with the scan speed and number of times of scans set, wherein said setting step sets the number of times of scans greater and the scan speed higher as the print density information is greater in value, and wherein said sensing step comprises detecting a print density of dots in a unit area in a range included in a predetermined area of a page and selecting a maximum value out of detected print densities and providing same as the print density information.

* * * * *